US006840373B2

(12) United States Patent
Gibler et al.

(10) Patent No.: US 6,840,373 B2
(45) Date of Patent: Jan. 11, 2005

(54) BEVERAGE STORAGE AND DISCHARGE CAP ASSEMBLY

(75) Inventors: Gregory A Gibler, 1301 W. 24th St., Lawrence, KS (US) 66067; Brian Hall, Ottawa, KS (US)

(73) Assignee: Gregory A Gibler, Lawrence, KS (US)

( * ) Notice: Subject to any disclaimer, the term of this patent is extended or adjusted under 35 U.S.C. 154(b) by 0 days.

(21) Appl. No.: 10/439,515

(22) Filed: May 16, 2003

(65) Prior Publication Data

US 2003/0213709 A1 Nov. 20, 2003

Related U.S. Application Data

(60) Provisional application No. 60/381,150, filed on May 16, 2002.

(51) Int. Cl.[7] ..... B65D 81/32
(52) U.S. Cl. ..... 206/219; 206/222; 215/DIG. 8
(58) Field of Search ..... 206/219, 221, 206/222; 215/DIG. 8; 222/81, 83.5, 83

(56) References Cited

U.S. PATENT DOCUMENTS 4,711,359 A * 12/1987 White et al. ..... 215/11.1
4,793,475 A * 12/1988 Itzel ..... 206/221
4,903,865 A * 2/1990 Janowitz ..... 222/83.5
4,962,852 A * 10/1990 Affaitati et al. ..... 206/222
4,982,875 A * 1/1991 Pozzi et al. ..... 222/83
5,543,097 A * 8/1996 Fang ..... 264/102
5,772,017 A * 6/1998 Kang ..... 206/222

* cited by examiner

*Primary Examiner*—David T. Fidei
(74) *Attorney, Agent, or Firm*—Dale J. Ream

(57) ABSTRACT

A beverage storage and discharge cap assembly includes an inner cylindrical housing rotatably nested within an outer cylindrical housing, the outer housing including a cap skirt having threads capable of being rotatably coupled to the neck of a bottle. The housings are hollow such that the inner housing may store a beverage substance therein, the inner housing having a closed top and the outer housing having a bottom wall for sealing the beverage substance within the cap assembly. A rotation of the inner housing causes a free edge thereof to rupture the bottom wall, thus releasing the stored beverage substance into the bottle whereby to interact with a beverage substance in the bottle. The housings include cooperating nubs that produce an audible sound or "pop" substantially simultaneous with rupture of the seal.

20 Claims, 10 Drawing Sheets

BEVERAGE STORAGE AND DISCHARGE CAP ASSEMBLY

REFERENCE TO RELATED APPLICATIONS

This application is a non-provisional application claiming the priority of provisional patent application, Serial No. 60/381,150, filed May 16, 2002.

BACKGROUND OF THE INVENTION

This invention relates generally to beverage container caps and, more particularly, to a two-part bottle cap for selectively storing or discharging one beverage substance into a bottle containing another beverage substance such that the two substances may be mixed into a single beverage.

Various nutritional and recreational beverages are known in the art which provide convenience and enjoyment to the consumer. Beverages having spouts or straws provide additional convenience for use in various environments or applications. In addition, mixing one beverage substance with a different beverage substance enables a user to selectively define a desired drink, e.g. mixing chocolate syrup with milk to form chocolate milk. It is also necessary or desirable to delay mixing certain beverage components until immediately prior to consumption. Although assumably effective for their intended purposes, existing devices are incapable of storing and then selectively dispensing one beverage substance into another so as to mix the two substances into a desired beverage combination in a simple and entertaining manner.

Therefore, it is desirable to have a beverage storage and discharge assembly which is capable of storing one beverage substance away from interaction with another beverage substance until selectively discharged therein by a user. Further, it is desirable to have a beverage storage and discharge assembly which provides an audible indicator when a stored substance has been discharged. Finally, it is desirable to have a beverage storage and discharge assembly which discharges a stored beverage substance upon a user twisting a storage cylinder.

SUMMARY OF THE INVENTION

The cap assembly according to the present invention includes nested inner and outer hollow cylindrical housings which cooperate to store and dispense beverage substances. The inner housing is selectably rotatable within the outer housing whereas the outer housing maintains a fixed position once attached to the spout of a beverage container. The inner housing, cooperating with the outer housing, forms a chamber for containing a beverage substance, whether the substance is liquid or powered concentrate.

The inner and outer housings are threaded such that the inner housing may be rotated in a downward relative movement whereby to rupture a breakable seal that forms a bottom wall of the outer housing. Thus, the chamber of the cap assembly may be placed in communication with a beverage substance in the beverage container so as to mix the two substances into a single beverage substance. Structures attached to the inner and outer housings are configured to contact one another as the inner housing is rotated so as to produce an audible indicator that the cap assembly beverage substance has been dispensed into the container. This "pop" indicates that the container may be shaken or otherwise agitated to facilitate complete mixing of the substances.

Therefore, a general object of this invention is to provide a cap assembly for storing a beverage substance and selectably dispensing that beverage substance into a container having another beverage substance.

Another object of this invention is to provide a cap assembly, as aforesaid, which provides an audible indicator when the stored beverage substance has been dispensed.

DESCRIPTION OF THE PREFERRED EMBODIMENT

Figure 1:
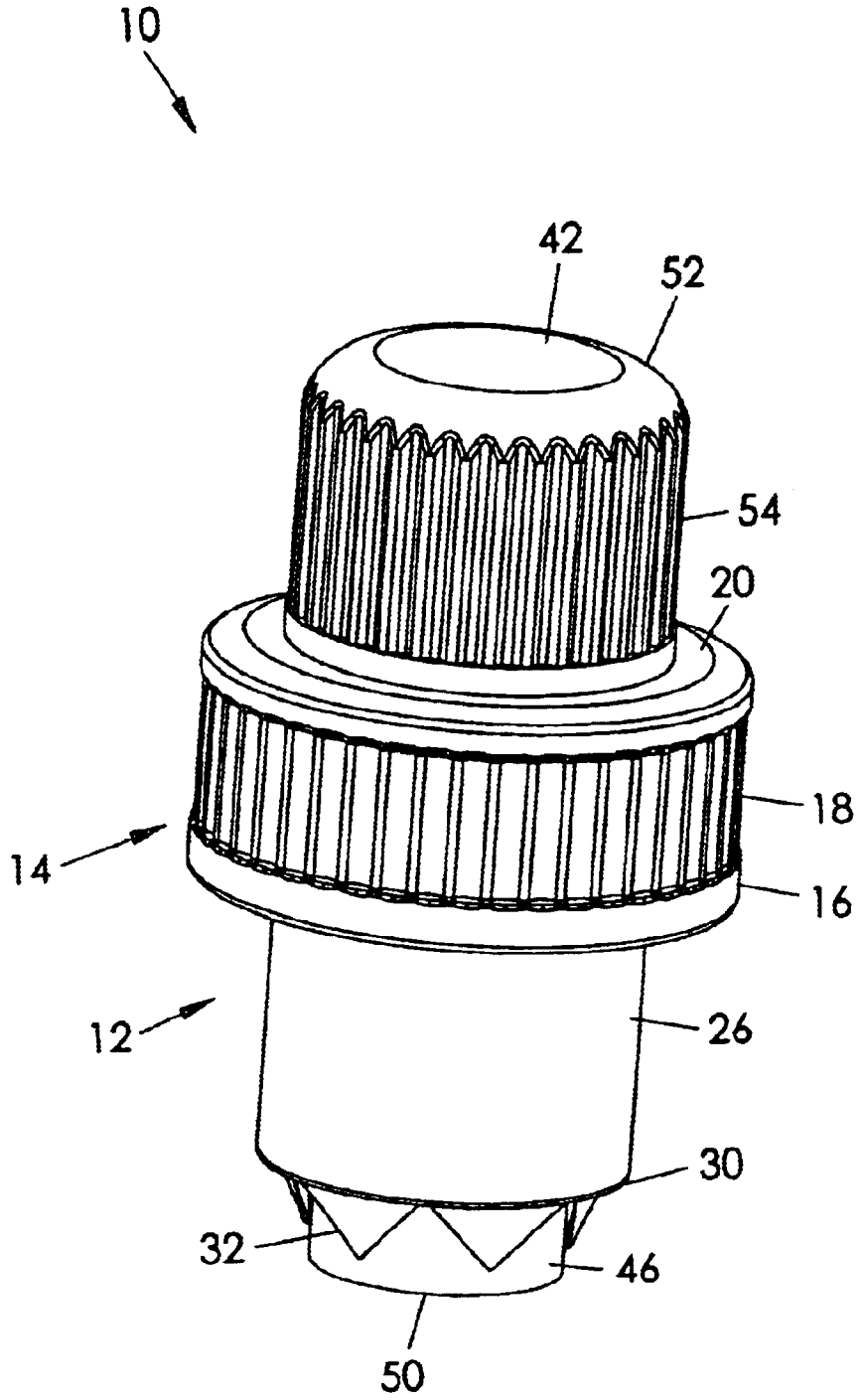
FIG. 1 is a perspective view of a beverage storing and discharge cap assembly according to a preferred embodiment of the present invention with inner and outer housings at a rupture configuration.

A beverage storing and discharge cap assembly 10 according to a preferred embodiment of the present invention will now be described in detail with reference to FIGS. 1 through 10 of the accompanying drawings. The beverage storing and discharge cap assembly 10 includes outer 12 and inner 40 cylindrical housings, the inner housing 40 being rotatably nested within the outer housing 12 (FIG. 1). The outer housing 12 is also referred to herein as the "first" housing and the inner housing 40 is also referred to herein as the "second" housing. More particularly, each housing includes a generally cylindrical side wall defining an interior bore. The inner housing 40 includes a closed top 42 and defines an open bottom and defines a chamber adapted to store a beverage substance, as to be described more fully later. The inner housing 40 also includes a funnel-shaped portion intermediate its ends for efficient dispensing of the stored beverage substance (FIG. 8).

Figure 7:
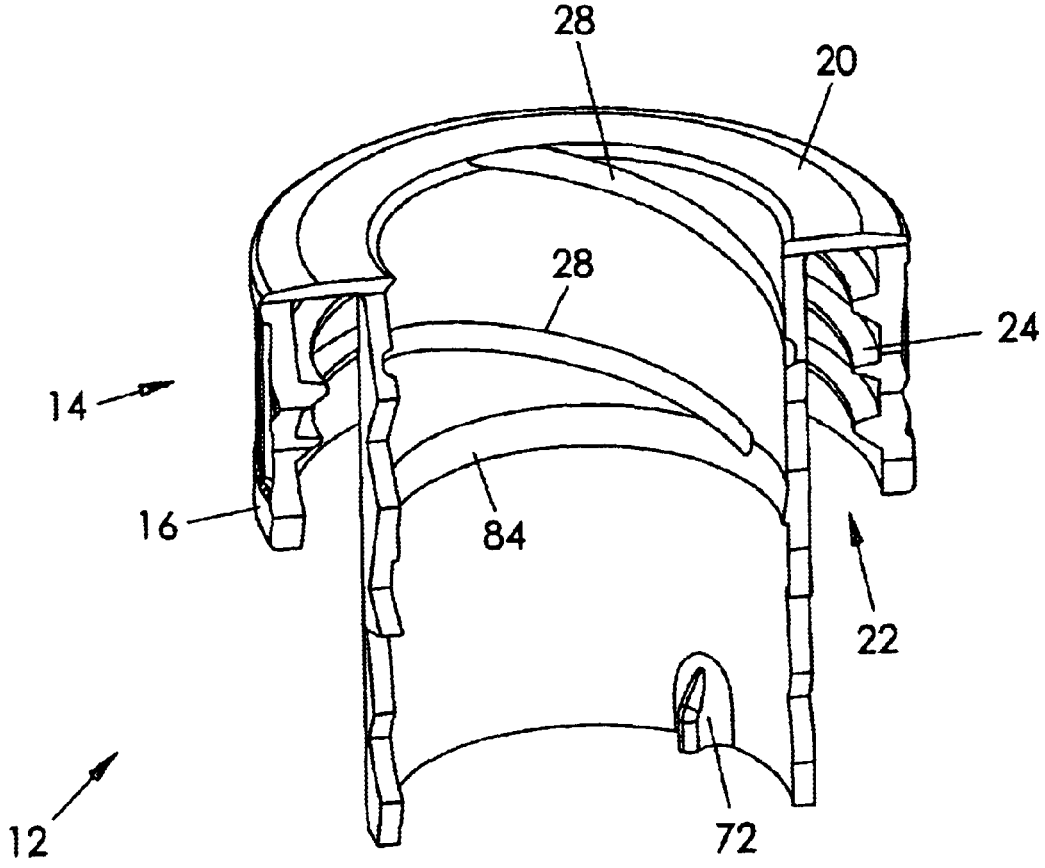
FIG. 7 is a fragmentary view of the outer housing as in FIG. 1 with the inner housing removed.
Figure 8:
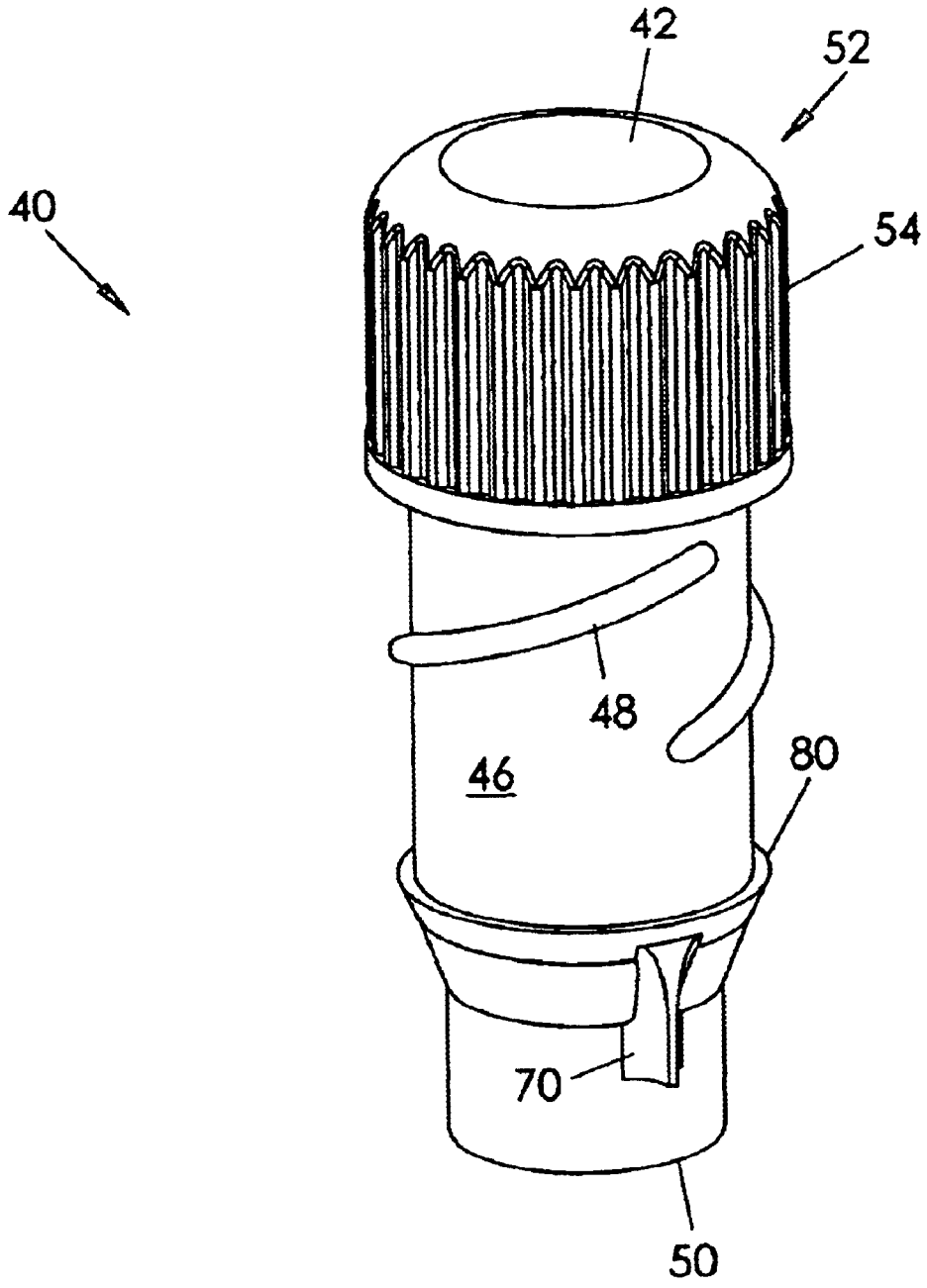
FIG. 8 is a perspective view of the inner housing as in FIG. 1 with the outer housing removed.

A cap skirt 14 is integrally connected to a top of the outer housing 12 and includes an annular outer wall 16 integrally connected to an annular upper rim 20, the rim 20 being integrally attached to a downwardly extending wall 26 of the outer housing 12 (FIG. 7). The cap skirt 14 defines a downwardly open slot 22 between the outer wall 16 of the cap skirt 14 and the outer wall 26 of the outer housing 12, the outer wall 16 of the cap skirt 14 being interiorly threaded 24 so as to be threadably coupled to the neck/spout of a beverage container (not shown).

Figure 2:
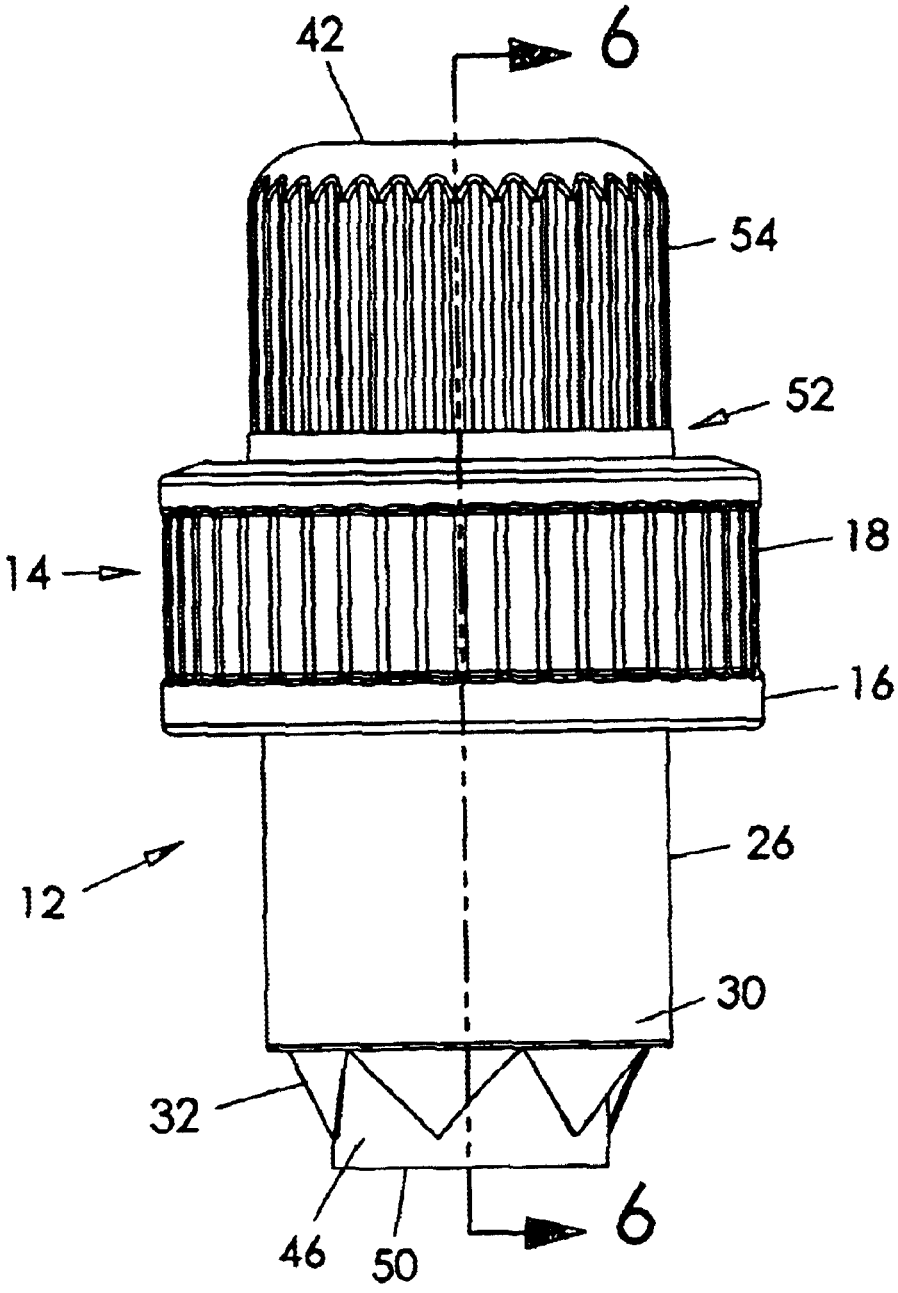
FIG. 2 is a front view of the cap assembly as in FIG. 1.

The outer wall 26 (i.e. cylindrical side wall) of the outer housing 12 defines a bore extending vertically therethrough. The inner housing 40 includes a length that is longer than a length of the outer housing 12 and a diameter that is slightly smaller than a diameter of the outer housing 12. Therefore, the inner housing 40 may extend completely through the outer housing 12 and is rotatable therein as to be described in more detail below. The outer surface 26 of the outer housing 12 includes interiorly positioned threads 28 at an upper end thereof (FIG. 7). The outer wall 46 of the inner housing 40 includes exteriorly positioned threads 48 substantially adjacent an upper end thereof (FIG. 8) that are complementary to the outer housing threads 28 such that the inner housing 40 is threadably rotatable within the outer housing 12. More particularly, the inner housing 40 is rotatable between a first/starting configuration in which an upper end thereof is upwardly displaced from the upper opening (and cap skirt) of the outer housing 12 (FIG. 3) and a second/rupture configuration in which a lower edge 50 of the inner housing 40 is downwardly displaced from the lower end 30 of the outer housing 12 (FIGS. 1 and 2). It is understood that the lower edge 50 of the inner housing 40 is maintained within the outer housing 12 at the starting configuration.

Figure 4:
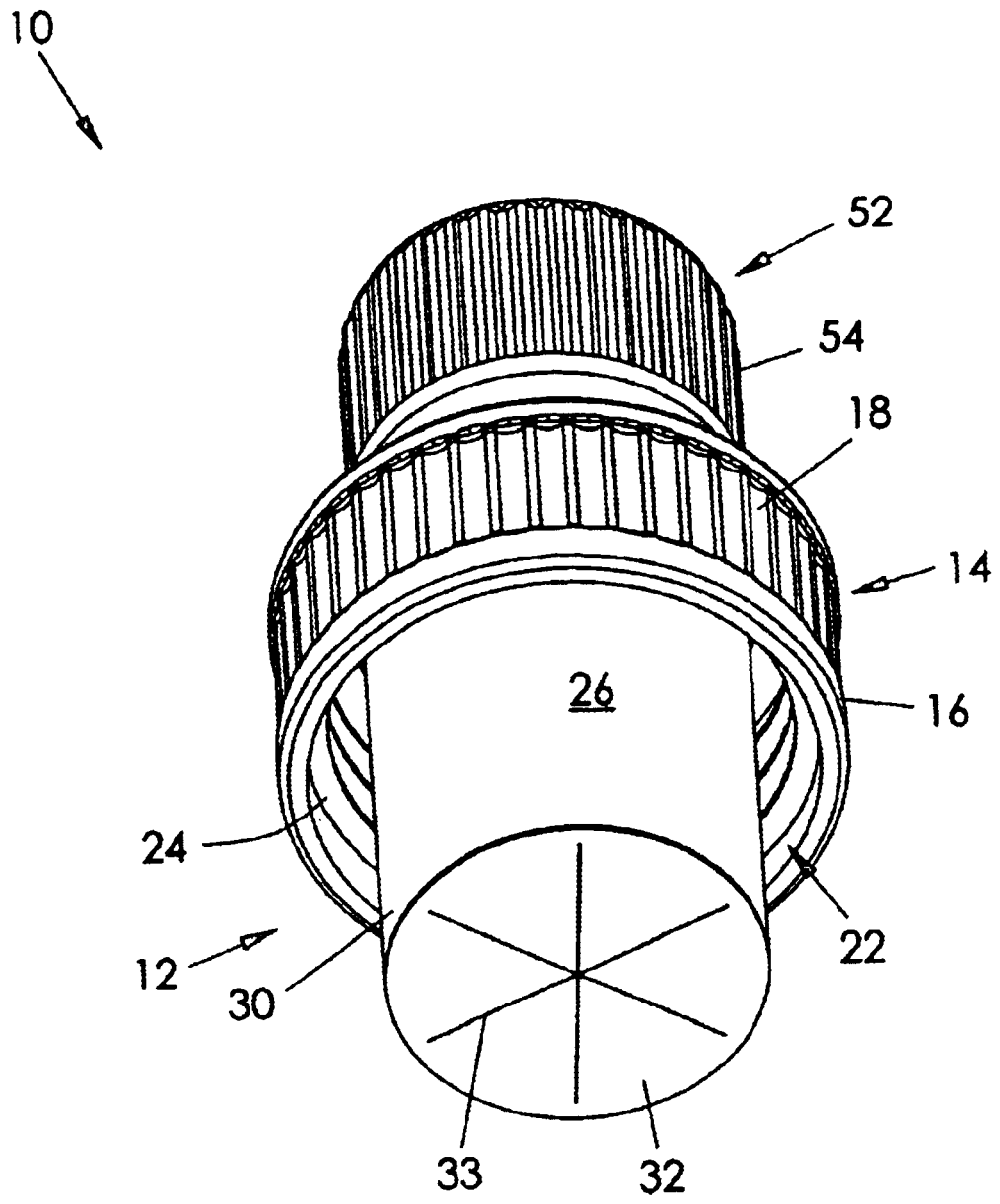
FIG. 4 is a bottom perspective view of the cap assembly as in FIG. 1.
Figure 5:
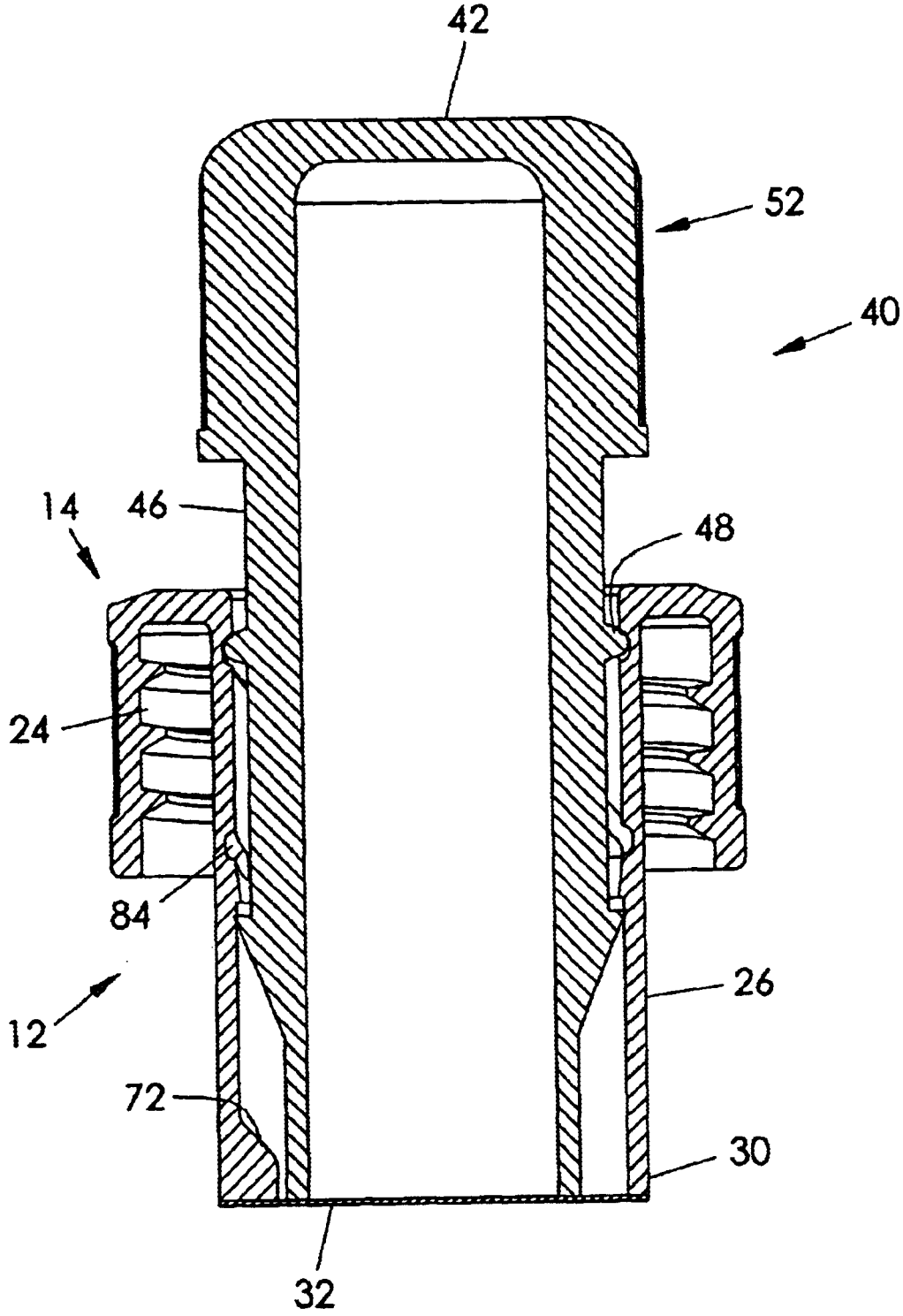
FIG. 5 is a sectional view of the cap assembly taken along line 5—5 of FIG. 3.
Figure 6:
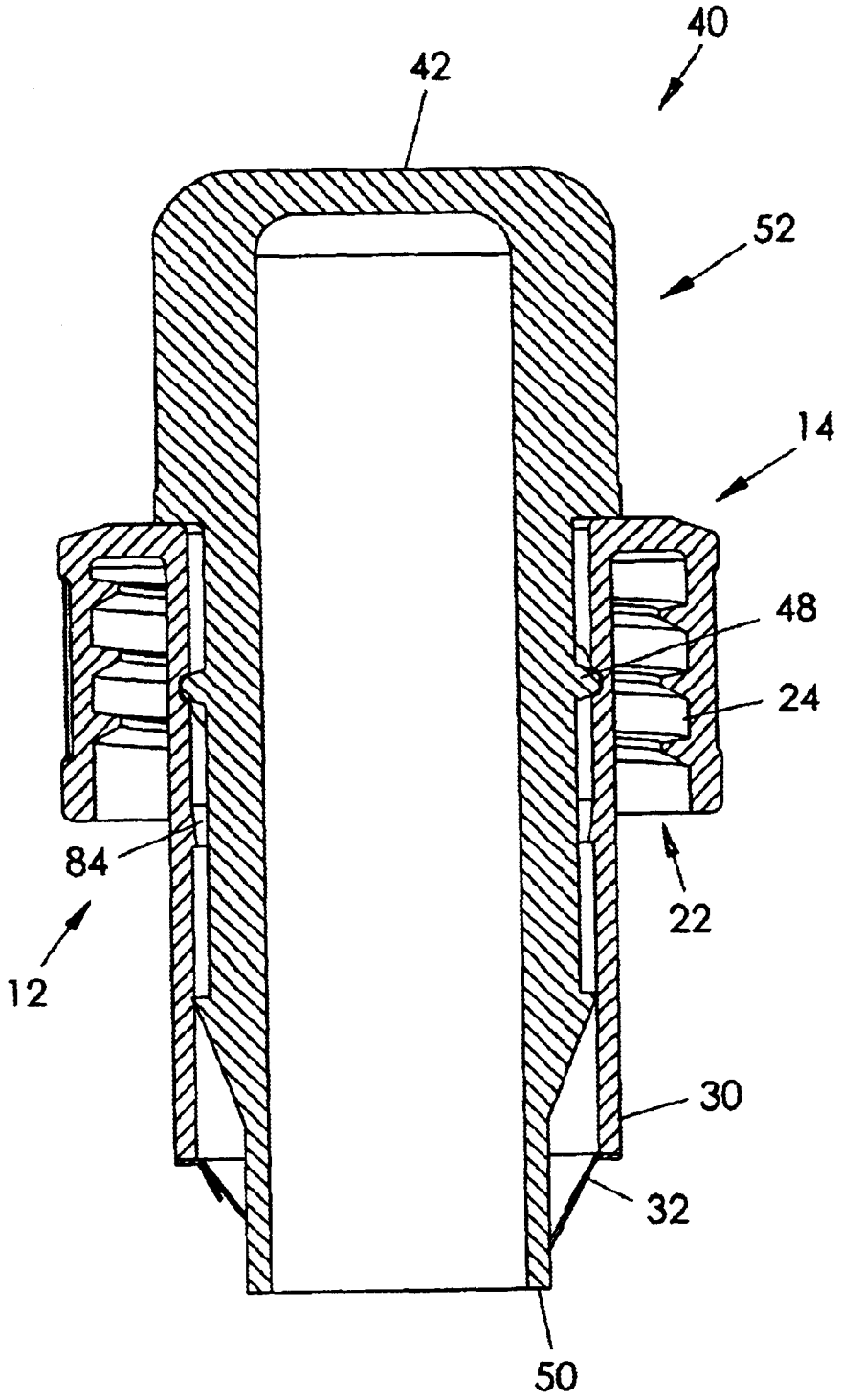
FIG. 6 is a sectional view of the cap assembly taken along line 6—6 of FIG. 2.

The outer housing 12 further includes a bottom wall 32 covering the otherwise open bottom end thereof (FIG. 4). This bottom wall 32 is preferably constructed of a thin plastic material or membrane which will easily rupture when pressure from the lower edge 50 of the inner housing 40 is urged thereupon in relative movement between first and second positions. However, a hinged plastic tab or other similar seal or fastener would also work. This bottom wall 32 is referred to as a breakable seal. The breakable seal may includes lines of weakness 33 or scored lines arranged in a pattern to enhance rupture at a predetermined focal point and to minimize fragmentation of the seal that may drop into the beverage container.

Figure 10:
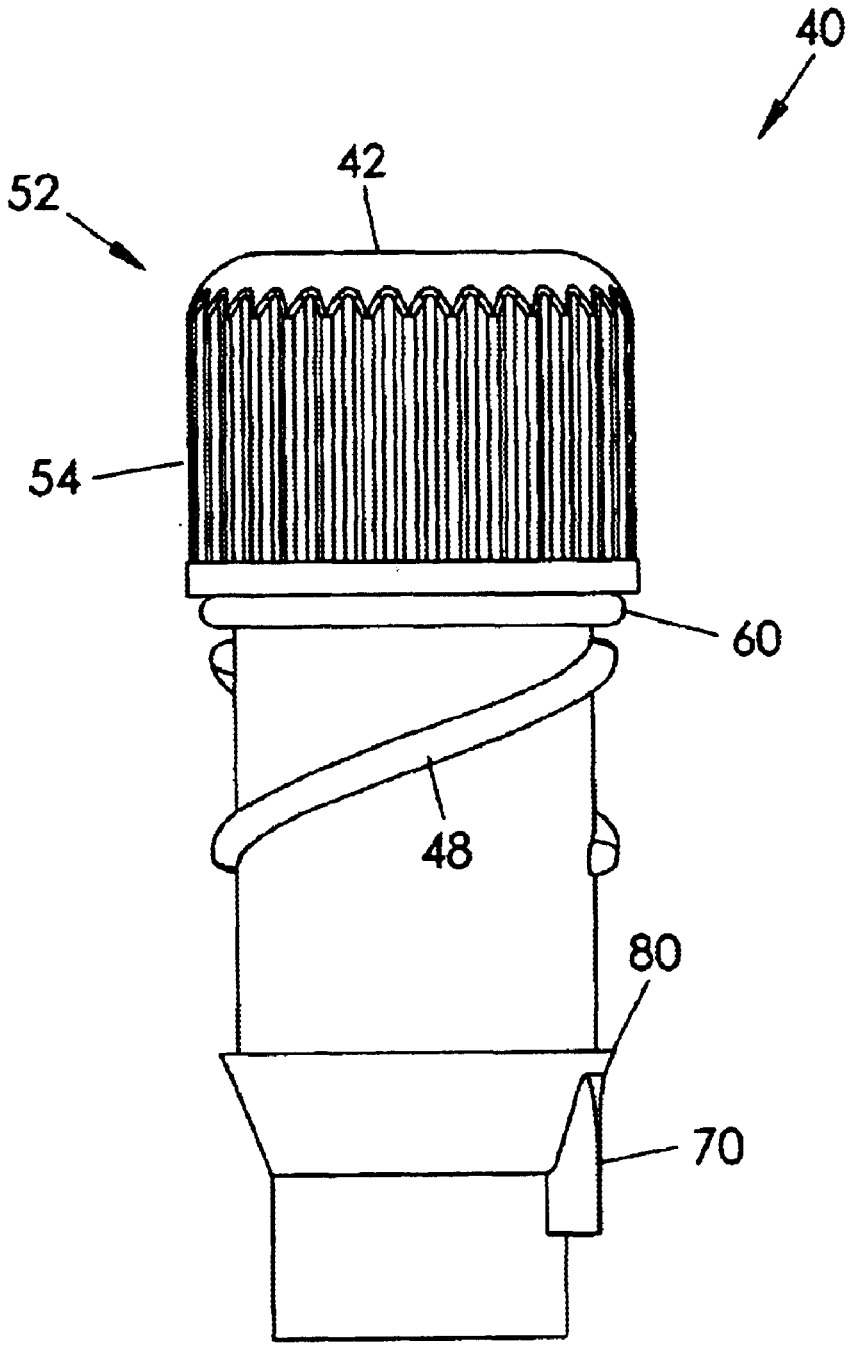
FIG. 10 is a perspective view of the inner housing as in FIG. 8 with an O-ring seal attached to the upper end portion.

The outer surface 16 of the cap skirt 14 includes a plurality of knurled edges 18 such that a user may more easily grip the cap skirt 14 between a thumb and finger when threadably attaching the cap assembly 10 to a threaded bottle neck or detaching it therefrom (FIG. 1). Similarly, an upper end portion 52 of the inner housing 40 includes another plurality of knurled edges 54. This upper end portion 52 may define an outside diameter larger than an outside diameter of the rest of the inner housing 40 such that the upper end portion 52 is not able to pass through the outer housing 12. In addition, an O-ring seal 60 may be attached to a lower edge of the upper end portion 52 that forms a seal between the upper end portion 52 and the cap skirt rim 20 at the rupture configuration so as to prevent liquid from flowing out of the open top of the outer housing 12 (FIG. 10).

The cap assembly 10 includes means for producing an audible indicator when a beverage substance stored therein has been dispensed. In the preferred embodiment, the sound indicator is provided by a pair of complementary and strategically configured nubs. More particularly, a first nub 70 is fixedly attached to an outer surface 46 of the inner housing 40 at a position displaced from the open bottom 50 thereof (FIG. 8). A second nub 72 is attached to the inner surface of the outer housing 12 adjacent the bottom thereof (FIG. 7). In function, the first 70 and second 72 nubs are configured to contact one another near a conclusion of threaded rotational movement between start and rupture configurations. As the first nub 70 passes across the second nub 72, an audible "pop" or "snap" is produced as an indication that the beverage substance contained in the cap assembly 10 has been dispensed into the container for mixture with the container beverage substance. It is understood that contact between the nubs causes minor resistance in the rotation of the inner housing 40 that is being imparted by a user. The sound indicator, however, results when a predetermined amount of additional force is applied by the user to overcome the resistance. The nubs are constructed of a material that has enough flexibility so as not to break or fragment as they pass together but rather provide a definitive "pop".

Figure 9:
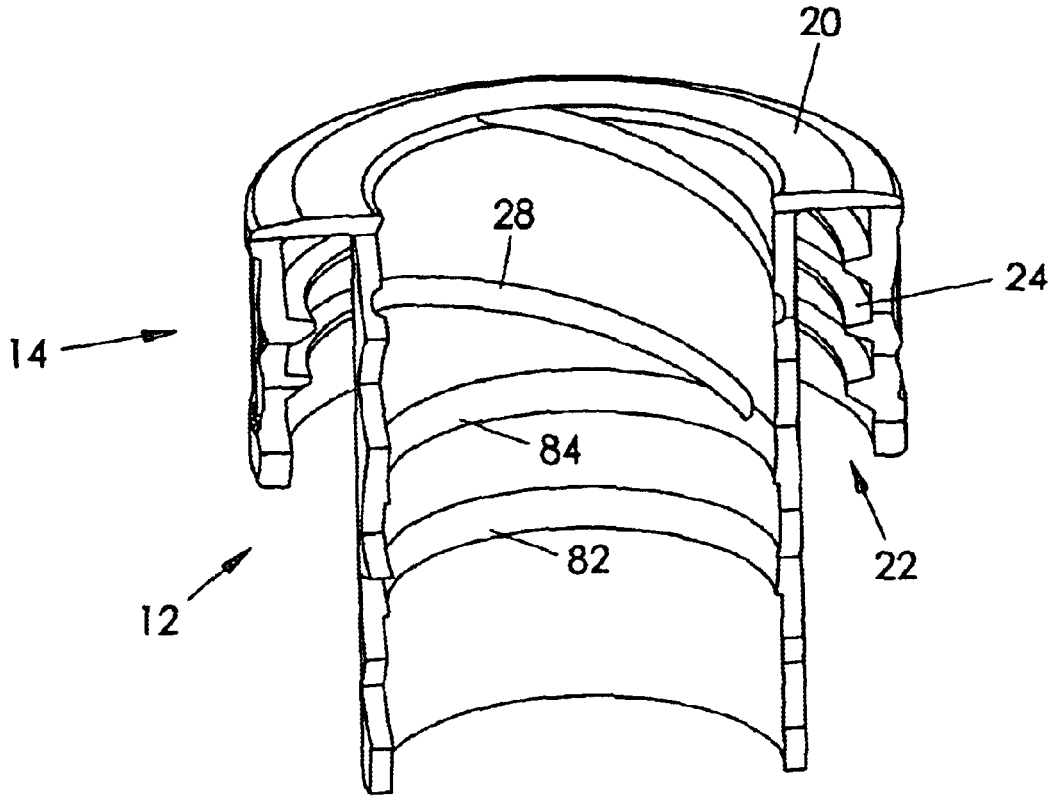
FIG. 9 is a fragmentary view of the outer housing according to another embodiment of the invention.

Alternatively, the means for providing an audible indicator may be provided with a pair of complementary rims. A rim 80 extends circumferentially about the outer surface 46 of the inner housing 40 (as in FIG. 8). A complementary rim 82 extends circumferentially about the inner surface of the outer housing (FIG. 9). As the inner housing is threadably moved between start and rupture configurations, the rim 80 and complementary rim 82 contact one another in an initial resistance and then to provide an audible sound indicator when a predetermined amount of additional force is applied by a user to overcome the resistance. It is understood that the rims are particularly configured to produce a desired sound indicator with minimal force requirements.

In addition, a stop rim 84 extends circumferentially about the inner surface of the outer housing 12 and is upwardly displaced from the outer housing rim 82 described above The stop rim 84 includes a diameter and configuration that allows the inner housing rim 80 to pass downwardly over it, such as during assembly at the point of manufacture, but does not allow the inner housing rim 80 to pass upwardly over it. In this context, the inner housing rim 80 may be termed an "assembly rim" (FIG. 9). In other words, once the inner housing 40 is inserted into the outer housing 12 at the point of manufacture, it can not be rotated back out. This is an important safety feature in that it prevents tampering. Each of the rims discussed above establish a seal between the inner 40 and outer 12 housings so as to prevent liquid (from the beverage container or from the inner housing chamber) from flowing between the housings and out the open top of the outer housing 12.

Figure 3:
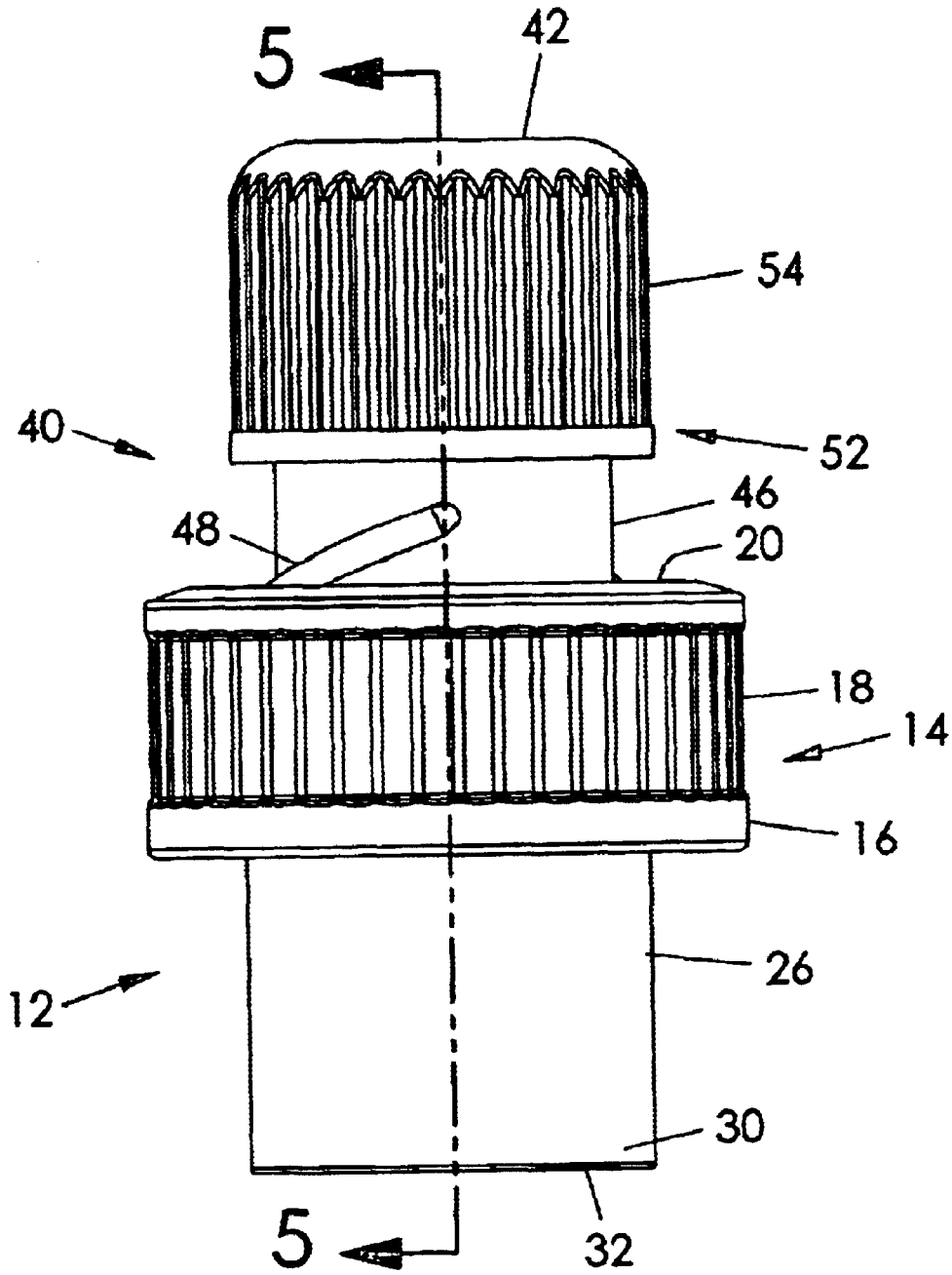
FIG. 3 is a front view of the cap assembly as in FIG. 1 with inner and outer housings at a starting configuration.

In function, the inner 40 and outer 12 housings are threadably coupled at a starting position in which the upper end portion 52 of the inner housing 40 is upwardly displaced from the upper rim 20 of the cap skirt 14 (FIG. 3). At this position, the lower/free edge 50 of the inner housing 40 is positioned within the outer housing 12 above the lower edge 30 and bottom wall 32 thereof. At the point of manufacture, the cap assembly 10 may be inverted at this starting position for filling the inner housing 40 with a beverage substance, whether in liquid, powder, or tablet form. Thus, the chamber defined by the inner housing 40 communicates via the open end defined by edge 50 with the inner bore of the outer housing 12 whereby to form a outer housing chamber for holding the beverage substance. The bottom wall 32 of the outer housing 12 may then be applied, whether by heat seal, plastic bonding, glue, or other suitable sealing means. Then, the cap assembly 10, having been filled and sealed, may be threadably coupled to a bottle containing another beverage substance, e.g. water. More particularly, the interiorly disposed threads 24 of the cap skirt 14 may be engaged with the threads of the neck of a bottle (not shown). It is understood that the cap assembly 10 would likely be sealed to the bottle container itself in a tamperproof manner at this point.

In use, a user may threadably rotate the inner housing 40 within the outer housing 12 such that the inner housing 40 moves downwardly therein and such that the lower/free edge 50 of the inner housing 40 bears against the bottom wall 32 of the outer housing 12. Rupture of the bottom wall 32 of the outer housing 12 allows the beverage substance contained within the inner housing 40 to be released into the beverage container for interaction with the beverage substance therein. A "pop"-like sound indicates that the beverage substance contained in the cap assembly has been dispensed into the container. Of course, a user may shake the entire bottle at this configuration to more completely and efficiently mix the two beverage substances together. Then, the cap skirt 14 may be threadably removed from the neck of the bottle to enable the user to consume the mixed beverage through the bottle neck or to pour it into another drink container. Alternatively, the inner housing 40 may be completely removed from the outer housing 12 (by counterclockwise rotation thereof) such that the mixed beverage may be consumed through the inner housing bore or poured therethrough into another container. Of course, a conventional pop-up spout or other spout means may be mounted atop the inner housing 40 to provide selective access to the inner housing bore.

Another embodiment of the present invention is substantially similar to the embodiment described previously except that a plunger assembly is coupled to the outer housing 12 in place of the inner housing 40.

Having thus described the invention, what is claimed as new and desired to be secured by letters patent is as follows:

1. A beverage storage and mixing cap assembly for attachment to a spout of a beverage container adapted to hold a first beverage substance therein, comprising:

a first housing having a generally cylindrical side wall defining a first housing open top and having a first housing bottom wall with a first housing bore extending longitudinally therebetween;

means for connecting said first housing to the spout of the beverage container such that said first housing extends into the beverage container;

a second housing for insertion in said first housing bore, said second housing having a generally cylindrical second housing side wall defining a second housing open bottom and having a second housing closed top, said second housing side wall defining a second housing bore extending between said second housing closed top and said second housing open bottom, an insertion of said second housing into said first housing causing said second housing bore to cooperate with said first housing so as to form a second housing chamber for containing a second beverage substance;

means for coupling said second housing to said first housing for relative movement of said second housing therein between first and second configurations, said second housing open bottom being situated within said first housing bore at said first configuration and said second housing open bottom extending beyond said first housing bottom wall at said second configuration for communicating said second housing bore with the container for mixing said first and second beverage substances;

means for resisting movement of said second housing from said first configuration to said second configuration, said resisting means being capable of producing an audible sound when a predetermined amount of force is applied to said second housing.

2. The assembly as in claim 1 wherein said first housing bottom wall is a breakable seal, a lower edge of said second housing side wall being capable of rupturing said breakable seal upon movement of said second housing from said first configuration to said second configuration, whereby to communicate said first housing bore with said container.

3. The assembly as in claim 2 wherein said first housing bottom wall includes lines of weakness to enhance breakage of said bottom wall and to minimize fragmenting thereof.

4. The assembly as in claim 1 wherein said resisting means includes a first rim extending circumferentially about an inner surface of said first housing side wall and a second rim extending circumferentially about an outer surface of said second housing side wall, said first and second rims being situated so as to contact one another when said second housing is moved from said first configuration to said second configuration, said first and second rims being configured so as to produce said audible sound upon contacting one another.

5. The assembly as in claim 1 wherein said resisting means comprises:

a first nub attached to an outer surface of said second housing side wall;

a second nub attached to an inner surface of said first housing side wall, said first and second nubs being configured to contact one another upon said relative movement of said first and second housings between said first and second configurations, said first and second nubs producing said audible sound when said first nub is moved across said second nub.

6. The assembly as in claim 5 wherein said first nub is displaced from said open bottom of said second housing and said second nub is adjacent said first housing bottom wall.

7. The assembly as in claim 1 wherein said connecting means comprises:

a skirt about said first housing side wall; and a plurality of threads on said skirt for engagement with a plurality of threads located on the spout of the container.

8. The assembly as in claim 7 further comprising:

a first plurality of knurled edges situated on an outer surface of said skirt for enhanced gripping by fingers of a person; and a second plurality of knurled edges situated on an outer surface of an upper end portion of said second housing for enhanced gripping by fingers of a person.

9. The assembly as in claim 1 wherein said coupling means comprises:

a plurality of threads about an interior of said first housing side wall;

a plurality of complementary threads about an exterior of said second housing side wall, an engagement of said respective threads of said first and second side walls coupling said first housing to said second housing for relative movement thereof.

10. The assembly as in claim 1 further comprising:

a stop rim extending circumferentially about an interior of said first housing side wall;

an assembly rim extending circumferentially about an exterior of said second housing side wall, said stop rim and said assembly rim having complementary configurations such that said stop rim precludes a movement of said assembly rim upwardly beyond said stop rim after the assembly rim has been moved downwardly beyond the stop rim upon said insertion of said second housing into said first housing.

11. The assembly as in claim 1 further comprising:

an upper end portion depending from said second housing closed top and having a diameter slightly larger than said first housing bore; and means connected to a lower edge of said upper end portion for forming a seal between said upper end portion and said second housing bore when said second housing is at said second configuration, whereby to prevent said first beverage substance from flowing through said first housing open top.

12. The assembly as in claim 1 further comprising sealing means for precluding liquid from flowing between said first and second housings when said second housing is inserted in said first housing bore.

13. A beverage storage and mixing cap assembly for attachment to a spout of a beverage container adapted to hold a first beverage substance therein, said assembly comprising:

a first housing comprising:

a first housing side wall having a generally cylindrical configuration defining a first housing chamber;

a first housing bottom wall at an end of said first housing chamber, said first housing side wall defining a first housing open end opposite said first housing bottom wall;

means in said first housing for attaching said first housing to the spout of the container such that said first housing chamber extends into an interior of the container;

a second housing configured for insertion in said first housing chamber, said second housing comprising:

a second housing side wall defining a second housing open end and having a second housing closed top, said second housing open end cooperating with said first housing chamber to form a second housing chamber upon said insertion of said second housing within said first housing chamber, said second housing chamber adapted to contain a second beverage substance;

means for providing a relative movement of said second housing within said first housing between a first configuration in which said second housing open end is situated in said first housing chamber adjacent said first housing bottom wall and a second configuration in which said second housing open end extends beyond said first housing bottom wall for communicating said second housing chamber with the container, whereby to mix said first and second beverage substances; and means on said first and second housings for cooperatively producing an audible sound upon movement of said second housing between said first and second configurations.

14. The assembly as in claim 13 wherein said first housing bottom wall is a breakable seal, said breakable seal being capable of being ruptured by a lower edge of said second housing side wall upon movement of said second housing from said first configuration to said second configuration.

15. The assembly as in claim 14 wherein said breakable seal includes lines of weakness for enhancing rupture of said breakable seal and inhibiting fragmentation thereof.

16. The assembly as in claim 13 wherein said means for providing a relative movement comprises:

a plurality of threads about an inner surface of said first housing side wall; and a plurality of complementary threads about an outer surface of said second housing side wall, an engagement of said respective threads of said first and second side walls coupling said first housing to said second housing for relative movement thereof.

17. The assembly as in claim 13 wherein said sound producing means comprises:

a first nub attached to an outer surface of said second housing side wall;

a second nub attached to an inner surface of said first housing side wall, said first and second nubs being configured to contact one another upon said relative movement of said second housing within said first housing between said first and second configurations, said first and second nubs producing said audible sound when said first nub is moved across said second nub.

18. The assembly as in claim 13 wherein said sound producing means comprises a first rim extending circumferentially about an inner surface of said first housing side wall and a second rim extending circumferentially about an outer surface of said second housing side wall, said first and second rims being configured so as to contact one another for production of a sound when said second housing is moved from said first configuration to said second configuration.

19. The assembly as in claim 13 wherein said attaching means comprises:

a skirt extending about said first housing side wall and connected to said first housing side wall adjacent said first housing open top; and a plurality of threads on an interior of said skirt for engagement with a plurality of threads the a spout of the container;

said assembly further comprising:

a first plurality of knurled edges situated on an outer surface of said skirt for providing an enhanced gripping of said skirt between a thumb and finger of a person; and a second plurality of knurled edges situated on an outer surface of an upper end portion of said second housing for providing an enhanced gripping between a thumb and finger of a person.

20. A beverage storage and mixing cap assembly for attachment to a spout of a beverage container adapted to hold a first beverage substance therein, said assembly comprising:

a first housing comprising:

a first housing side wall defining a first housing chamber;

a first housing bottom wall at an end of said first housing chamber, said first housing side wall defining a first housing open end opposite said first housing bottom wall;

a skirt extending about said first housing side wall;

a plurality of threads on an inner surface of said skirt for engagement with a plurality of threads on the spout of the container, whereby to releasably couple said first housing to the spout of the container such that said first housing chamber extends into an interior of the container;

a second housing configured for insertion in said first housing chamber, said second housing comprising:

a second housing side wall defining a second housing open end and having a second housing closed top, said second housing open end cooperating with said first housing chamber to form a second housing chamber upon said insertion of said second housing within said first housing chamber, said second housing chamber adapted to contain a second beverage substance;

a plurality of threads about an inner surface of said first housing side wall;

a plurality of complementary threads about an outer surface of said second housing side wall, an engagement of said respective threads of said first and second side walls coupling said first housing to said second housing for relative movement of said second housing within said first housing between a first configuration in which said second housing open end is situated in said first housing chamber adjacent said first housing bottom wall and a second configuration in which said second housing open end extends beyond said first housing bottom wall for communicating said second housing chamber with the container, whereby to mix said first and second beverage substances;

means on said first and second housings for producing an audible sound upon movement of said second housing between said first and second configurations, wherein said sound producing means includes:

a first nub attached to said outer surface of said second housing side wall;

a second nub attached to said inner surface of said first housing side wall, said first and second nubs being configured to contact one another upon said relative movement of said second housing within said first housing between said first and second configurations, said first and second nubs producing said audible sound when said first nub is moved across said second nub; and means for precluding liquid from flowing between said first and second housings when said second housing is inserted in said first housing chamber.

* * * * *